US009738100B2

(12) United States Patent
Shiohara et al.

(10) Patent No.: US 9,738,100 B2
(45) Date of Patent: Aug. 22, 2017

(54) OPENING/CLOSING STRUCTURE OF OPENING/CLOSING COVER

(71) Applicant: Brother Kogyo Kabushiki Kaisha, Nagoya-shi, Aichi-ken (JP)

(72) Inventors: Yukio Shiohara, Nagoya (JP); Yoshinori Osakabe, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/430,626

(22) Filed: Feb. 13, 2017

(65) Prior Publication Data

US 2017/0151819 A1 Jun. 1, 2017

Related U.S. Application Data

(63) Continuation of application No. 14/866,126, filed on Sep. 25, 2015, now Pat. No. 9,565,931.

(30) Foreign Application Priority Data

Sep. 25, 2014 (JP) ..... 2014-195138

(51) Int. Cl.
*B41J 29/02* (2006.01)
*E05D 3/02* (2006.01)
(Continued)

(52) U.S. Cl.
CPC ..... *B41J 29/02* (2013.01); *E05D 3/02* (2013.01); *E05D 7/1077* (2013.01); *E05D 11/06* (2013.01); *E06B 5/00* (2013.01); *E05Y 2900/608* (2013.01)

(58) Field of Classification Search
CPC ..... B41J 29/026; B41J 29/023; B41J 29/02; B41J 29/06; B41J 29/04; B41J 29/08; B41J 29/10; B41J 29/12; B41J 29/13; B41J 29/14; B41J 29/15; E05D 3/02; E05D 7/1077; E05D 11/06; E06B 5/00
See application file for complete search history.

(56) References Cited

U.S. PATENT DOCUMENTS 7,425,064 B2 9/2008 Koga
7,631,965 B2 12/2009 Samoto et al.
(Continued)

FOREIGN PATENT DOCUMENTS

JP 2008-290255 A 12/2008
JP 2009-023808 A 2/2009
(Continued)

*Primary Examiner* — Kristal Feggins
(74) *Attorney, Agent, or Firm* — Banner & Witcoff, Ltd.

(57) ABSTRACT

An opening/closing structure of a cover includes a casing and a rotatable cover. A shaft part and a bearing part are formed to one and the other of the casing and the cover, respectively. One of the shaft part and the bearing part is formed with one of a protrusion and a relief part on a part of an end surface in an axial direction, and the other of the shaft part and the bearing part is formed with the other of the protrusion and the relief part on a facing surface facing the end surface. The protrusion circumvents contact with the surface having the relief part when the cover is closed. When the cover is opened, from the closed state, by a particular angle, the protrusion contacts the surface so as to be applied with a resistant force against rotation of the cover.

7 Claims, 8 Drawing Sheets

(51) Int. Cl.

| | |
|---|---|
| ***E05D 11/06*** | (2006.01) |
| ***E05D 7/10*** | (2006.01) |
| ***E06B 5/00*** | (2006.01) |

(56) References Cited

U.S. PATENT DOCUMENTS

| | | | | |
|---|---|---|---|---|
| 8,490,966 | B2 | 7/2013 | Iwama et al. | |
| 8,634,745 | B2 | 1/2014 | Tomatsu | |
| 8,708,482 | B2 | 4/2014 | Yamamoto | |
| 2005/0162501 | A1* | 7/2005 | Seo | B26D 1/045 347/157 |
| 2009/0022539 | A1 | 1/2009 | Iwama et al. | |
| 2011/0318050 | A1 | 12/2011 | Tomatsu | |
| 2013/0222470 | A1* | 8/2013 | Tamaki | B41J 2/16505 347/29 |
| 2015/0145941 | A1* | 5/2015 | Gao | B41J 29/13 347/217 |
| 2015/0165801 | A1* | 6/2015 | Murata | B41J 29/13 347/108 |

FOREIGN PATENT DOCUMENTS

| | | | |
|---|---|---|---|
| JP | 2012-011578 | A | 1/2012 |
| JP | 2013-057968 | A | 3/2013 |

* cited by examiner

OPENING/CLOSING STRUCTURE OF OPENING/CLOSING COVER

CROSS-REFERENCE TO RELATED APPLICATION

This application is a continuation of prior U.S. application Ser. No. 14/866,126, filed Sep. 25, 2015, which claims priority under 35 U.S.C. §119 from Japanese Patent Application No. 2014-195138 filed on Sep. 25, 2014. The entire subject matter of the application is incorporated herein by reference.

BACKGROUND

Technical Field

The present disclosures relate to an opening/closing structure of an opening/closing cover provided to a printer or the like.

Related Art

Conventionally, among image forming apparatuses such as an inkjet printer, there is an apparatus configured such that an opening/closing cover is provided to a casing and is opened to exchange ink cartridges. There is also known an apparatus provided with an opening/closing cover at an inlet of an insertion slot of a medium card such as an SD (secure digital) memory card.

For example, there is known a structure which is configured such that an opening is formed on an upper cover, which forms an upper surface of a casing, and an access cover, which is an opening/closing cover, is provided to open/close the opening.

Specifically, according to the conventional structure, the access cover is rotatably supported by shaft supporting parts provided to the upper surface of the casing. When the access cover is rotated in a direction where the access cover in an open state is changed to a closed state, the access cover is rotated by its own weight so as to be set to the closed state. In the vicinity of bearing parts of the access cover, a sliding-contact protrusion protruding toward the upper cover is formed, while in the vicinity of the shaft supporting part of the upper cover, three crests-shaped protrusions protruding toward the access cover in the form of crests are formed. When the state of the access cover is changed from the open state to the closed state, the sliding-contact protrusion and the crests-shaped protrusions slidably contact with each other, thereby a force opposing rotation of the access cover being applied to the access cover. As a result, the access cover is closed quietly.

SUMMARY

According to the conventional opening/closing structure, the slide-contacting protrusion is formed in the vicinity of the bearing part of the access cover is arranged on a peripheral part of a plate spring extending, from the bearing part, in a radial direction of the rotation shaft. Therefore, a relatively large space is necessary to form the slide-contact protrusion and the crests-shaped protrusions to contact the slide-contacting protrusion, which leads to upsizing of the apparatus.

Further, in such conventional art, the access cover (i.e., opening/closing cover) is configured to open/close the opening formed on the upper surface of the casing, and the opening is in the closed state when the access cover extends horizontally. There is no disclosure in the conventional art regarding a structure in which an opening is formed on a vertical surface (e.g., side walls or front surface) of the casing, and is closed by the access cover when the access cover is in a vertical posture.

The access cover which opens/closes the opening formed on a vertical wall of the casing and the opening is closed when the access cover is in the vertical posture is configured such that a down side part of the access cover is connected with the casing via hinges so that the access cover is rotatable about the down side part thereof. The structure is further configured such that, when the access cover closes the opening, the up side part of the access cover engages with the casing to hold the access cover in position. In such a structure, in order to ease the positioning of the access cover in the closed state, the hinge connection is made relatively loose. Therefore, when the access cover is opened, rattling may be caused. For example, by pulling the up side part of the access cover to release the engagement between the up side part of the access cover and the casing, it becomes possible to rotate the access cover downward. At this stage, if the access cover is rotated to open with great force due to its own weight, the access cover may bounce at its fully opened position, which may cause displeasure to the user.

In consideration of the above, aspects of the disclosures provide an improved opening/closing structure of an opening/closing cover which is configured to close an opening in a vertical posture. According to the improved opening/closing structure, positioning of the opening/closing cover when in the closed state is not prevented, while, rattling of the opening/closing cover when the opening/closing cover is opened is prevented and enabling gentle opening of the opening/closing cover, and further, upsizing of an apparatus employing the opening/closing structure is suppressed.

According to aspects of the disclosures, there is provided an opening/closing structure of a cover, which includes a casing having an opening and a cover configured to be rotatable with respect to the casing. One of the casing and the cover is formed with a shaft part having a shaft, and the other of the casing and the cover is formed with a bearing part having a bearing. Further, one of the shaft part and the bearing part is formed with one of a protrusion and a relief part on a part of an end surface in an axial direction, and the other of the shaft part and the bearing part is formed with the other of the protrusion and the relief part on a facing surface facing the end surface. The protrusion circumvents, corresponding to the relief part, contact with the end surface or the facing surface on which the relief part is formed when the cover is in a closed state in which the cover closes the opening. When the cover is in an open state in which the cover is opened, from the closed state, by a particular angle, the protrusion moves out of the relief part and contacts one of the end surface and the facing surface on which the relief part is formed so as to be applied with a resistant force against rotation of the cover.

According to the above configuration, when the opening/closing cover is in the closed state to close the opening, the protrusions does not contact one of the end surface of the facing surface formed with the relief part. Therefore, the positioning of the opening/closing cover in the closed state is not prevented. Further, when the opening/closing cover is opened, with respect to the closed state, by a particular angle, the protrusions move out of the relief parts and contact the surfaces provided with the relief parts, respectively, thereby resistance is applied against the rotation of the opening/closing cover. Accordingly, the rattling of the opening/closing cover is absorbed and the opening/closing cover is opened gently. Since the protrusions and relief parts are formed on surfaces orthogonal to axes of the shafts and bearings, upsizing of an apparatus can be suppressed.

BRIEF DESCRIPTION OF THE ACCOMPANYING DRAWINGS

Figure 6B:
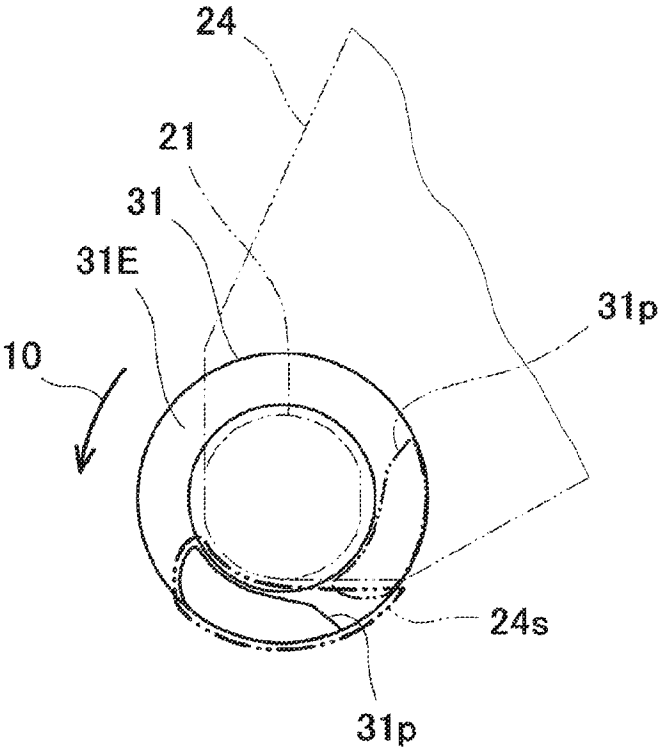
Figure 6A:
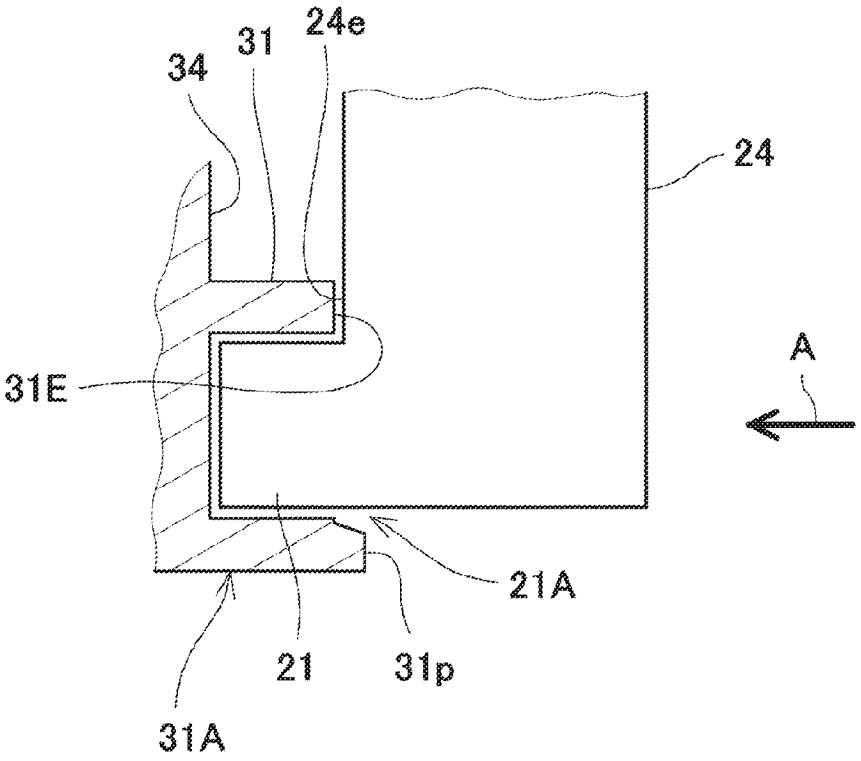

FIG. 6A schematically shows a positional relationship between a shaft part and the bearing part viewed from a front side according to the embodiment of the disclosures.

FIG. 6B schematically shows a positional relationship between the shaft part and the bearing part viewed from aside according to the embodiment of the disclosures.

Figure 7B:
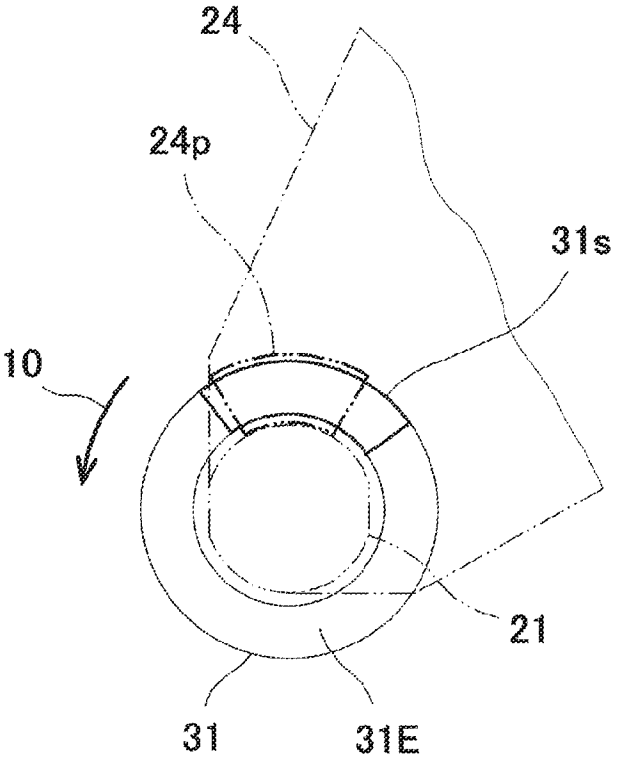
Figure 7A:
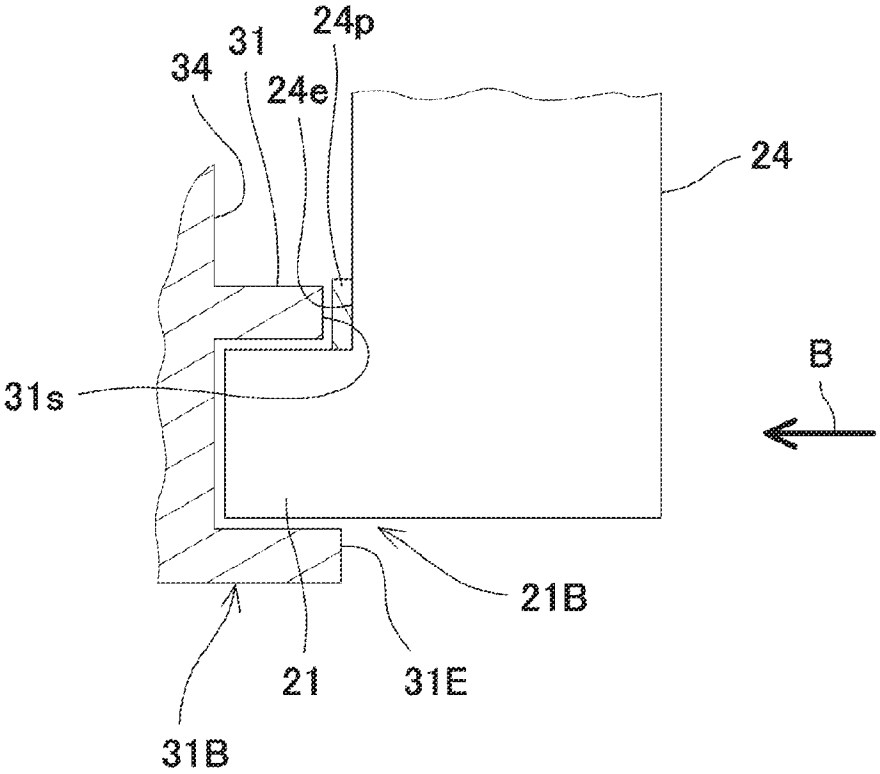

FIG. 7A schematically shows a positional relationship between a shaft part and the bearing part viewed from a front side according to a first modified embodiment of the disclosures.

FIG. 7B schematically shows a positional relationship between the shaft part and the bearing part viewed from aside according to the first modified embodiment of the disclosures.

Figure 8B:
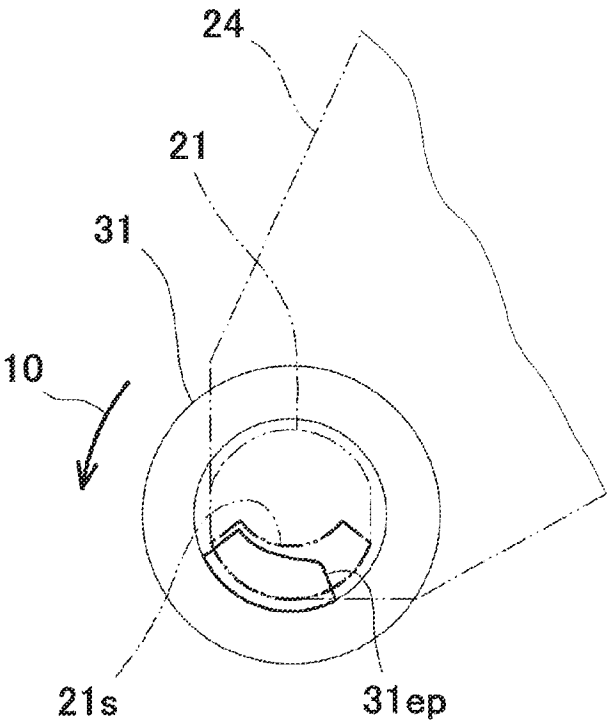
Figure 8A:
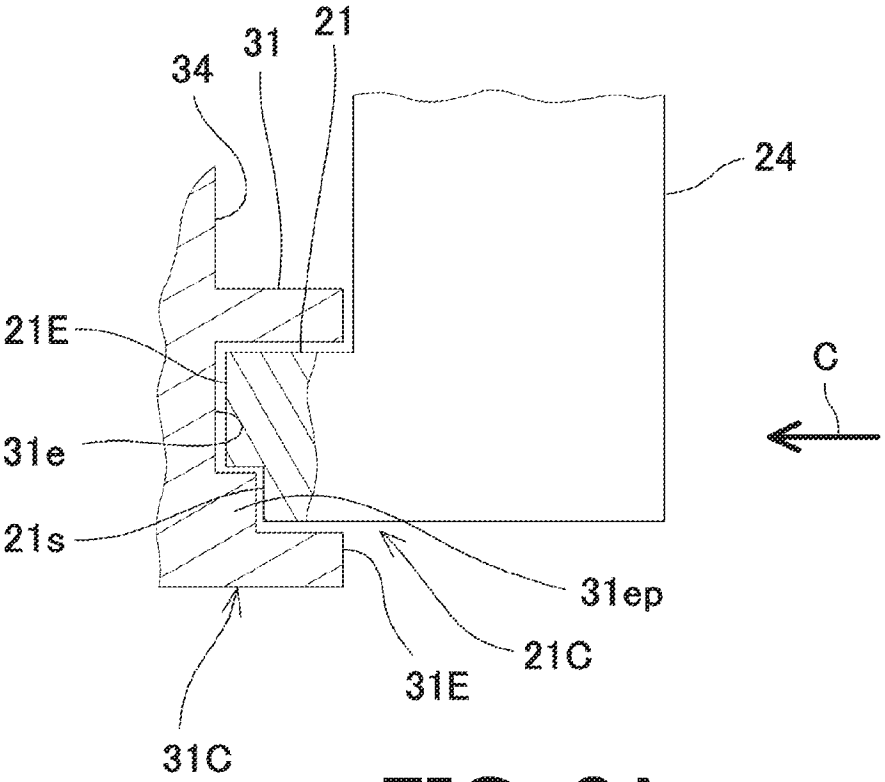

FIG. 8A schematically shows a positional relationship between a shaft part and the bearing part viewed from a front side according to a second modified embodiment of the disclosures.

FIG. 8B schematically shows a positional relationship between the shaft part and the bearing part viewed from aside according to the second modified embodiment of the disclosures.

DETAILED DESCRIPTION OF EMBODIMENTS

Hereinafter, referring to the accompanying drawings, embodiments according to aspects of the disclosures will be described.

An embodiment and modified embodiments described below are only illustrative examples, and shapes, materials, structural components, arrangement/location of the components and the like are only illustrative ones and are not intended to limit the aspects of the disclosures. It is noted that, in the following description and drawings, same or corresponding components are assigned with same reference numerals, and descriptions thereof may be omitted to avoid repetition and for brevity.

<Embodiment>

Figure 1:
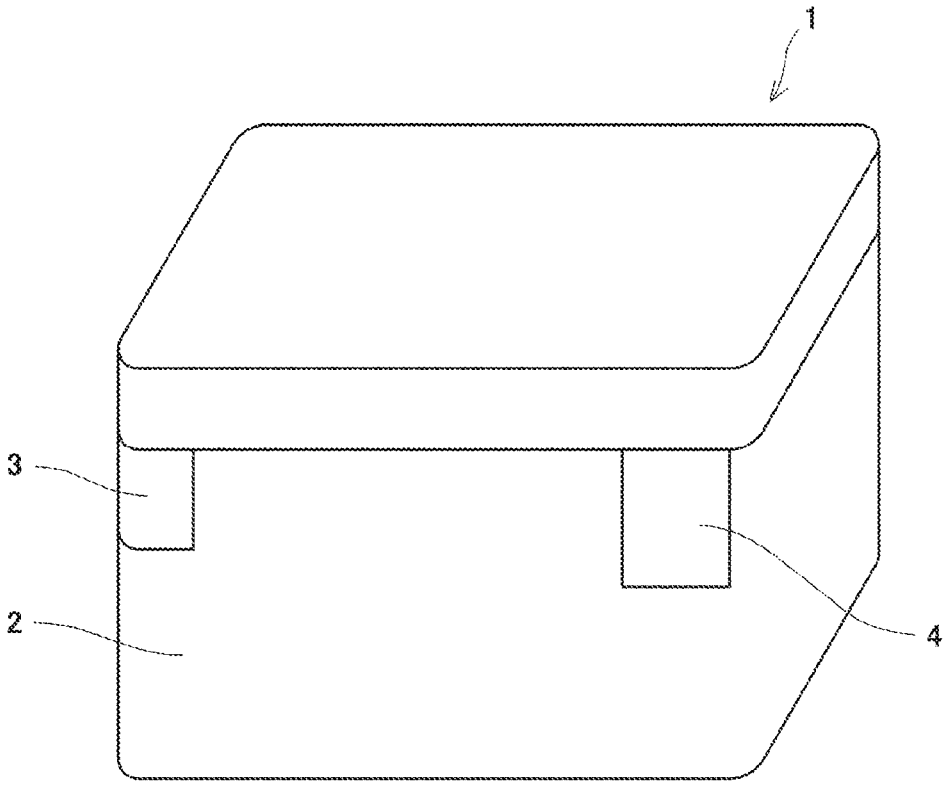
FIG. 1 is a perspective view schematically showing an appearance of an image forming apparatus to which an opening/closing structure according to an illustrative embodiment of the disclosures is applied.

FIG. 1 is a perspective view schematically showing an appearance of an image forming apparatus to which an opening/closing structure according to an illustrative embodiment of the disclosures is applied.

As shown in FIG. 1, an image forming apparatus 1 is for example an inkjet printer, which has a casing 2, an opening/closing cover 3 which is configured to open/close a slot for medium card such as an SD memory card formed on a front surface of the casing 1, and another opening/closing cover 4 which is opened/closed when an ink cartridge is exchanged.

Figure 2C:
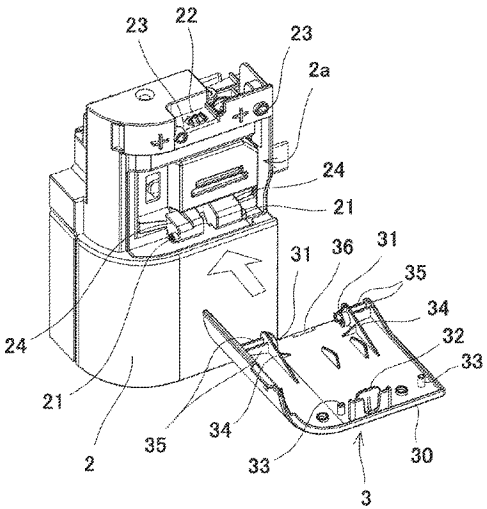
FIG. 2C is a perspective view of the opening/closing cover and the structure in the vicinity thereof when the opening/closing cover is removed.
Figure 2B:
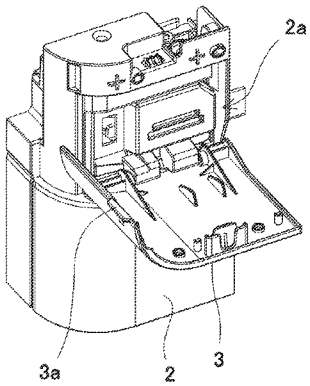
FIG. 2B is a perspective view of the opening/closing cover and the structure in the vicinity thereof when the opening/closing cover is in an open state.
Figure 2A:
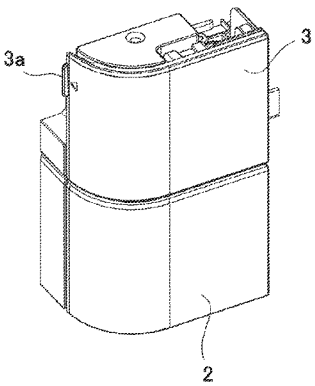
FIG. 2A is a perspective view of the opening/closing cover and a structure in the vicinity thereof when the opening/closing cover is in a closed state.

Each of FIGS. 2A-2C is a perspective view showing the opening/closing cover 3 and in the vicinity thereof. FIG. 2A shows when the opening/closing cover 3 is in a closed state, FIG. 2B shows when the opening/closing cover 3 is in an open state, and FIG. 2C shows a case where the opening/closing cover 3 is removed.

The opening/closing cover 3 is for opening/closing an opening 2*a* formed on a vertical surface of the casing 2. On the casing 2, two shafts 21 are provided at down side parts of the opening 2*a* via shaft supporting parts 24. The opening/closing cover 3 is configured such that two bearings 31 are provided on a down side part, when the opening/closing cover 3 is in the closed state, of a cover body 30. By inserting the shafts 21 in the bearings 31, respectively, the opening/closing cover 3 is rotatably supported on the casing 2. That is, the shafts 21 and the bearings 31 configure a hinge structure.

The opening/closing cover 3 is configured such that a handle 3*a* is provided on a peripheral part of the cover body 30. The user can open the opening/closing cover 3 by pulling the handle 3*a*. When the opening/closing cover 3 is to be closed, the user may rotate the cover body 30 upward. The opening/closing cover 3 takes a vertical posture when in the closed state, while takes a substantially horizontal posture when in the fully opened state.

On the casing 2, an engaging part 22 is formed above the opening 2*a*, and two positioning holes 23 used to position the opening/closing cover 3 at a particular position when closed are formed (see FIG. 2C). On the cover 3, an engaged part 32 which is to be engaged with the engaging part 22 of the casing 2, and two positioning pins correspond to the two positioning holes formed on the casing 2 are formed (see FIG. 2C). When the opening/closing cover 3 is closed, the positioning pints 33 are inserted in the positioning holes 33, respectively, thereby the opening/closing cover 3 being positioned with respect to the casing 2 precisely. Further, as the engaged part 32 is engaged with the engaging part 22, the closed state is maintained once the opening/closing cover 3 is closed. It is noted that the above configuration may be modified such that the positioning pins may be provided to the casing 2 and the positioning holes may be formed on the opening/closing cover 3.

Figure 3B:
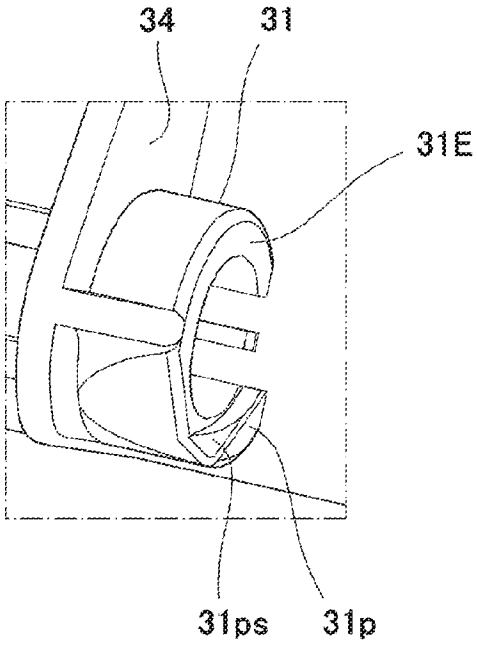
FIG. 3B is an enlarged view of a bearing part of the opening/closing cover according to the illustrative embodiment
Figure 3A:
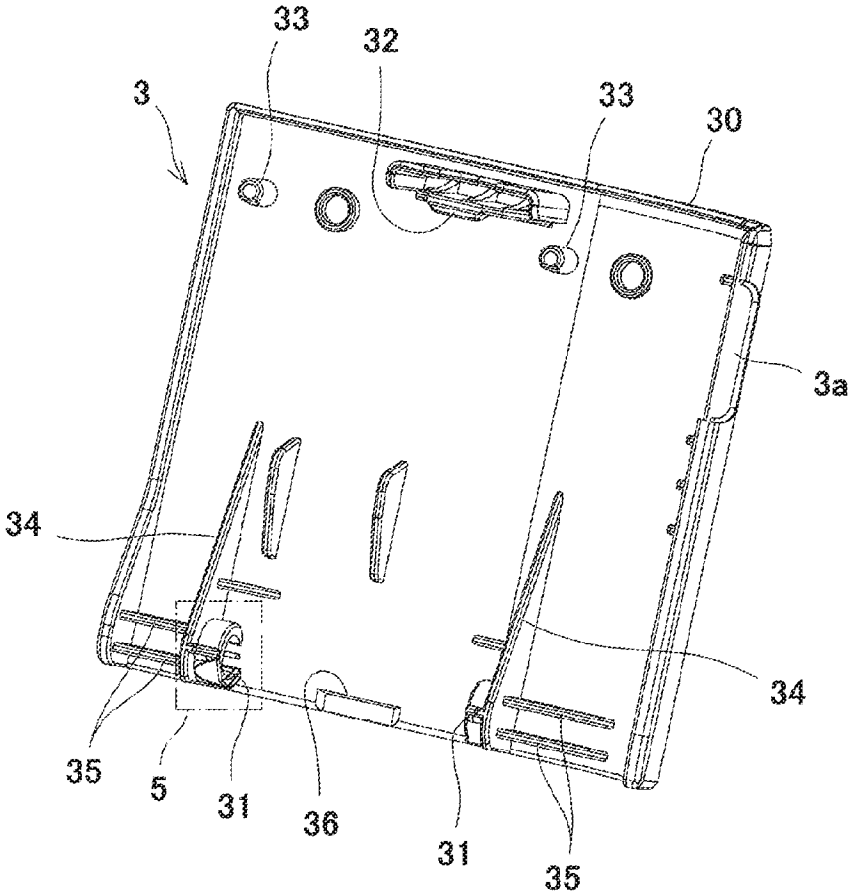
FIG. 3A is an enlarged view of the opening/closing cover according to the illustrative embodiment of the disclosure.

FIG. 3A is an enlarged view of the opening/closing cover 3, and FIG. 3B is an enlarged view of the bearing part 31 (a portion of FIG. 3A surrounded by broken lines 5) of the opening/closing cover 3.

The opening/closing cover 3 is made of resin and all the parts thereof are integrally molded. The two bearings 31 are arranged between both ends of the cover body 30 while arranged separately, in the axial direction. The two bearings 31 are respectively connected with two bearing support parts 34, which are arranged in parallel (see FIG. 3A). Between the bearing supporting part 34 and the ends, in the axial direction, of the cover body 30, reinforcement ribs 35 are provided. There are no reinforcement parts on the cover body 30 at a portion between the two bearings 31. Because of this structure, the portion of the cover body 30 between the two bearings 31 can be bent more easily than the portions between the bearings 31 and respective ends of the cover body 30, where the reinforcement ribs 35 are provided. By bending the portion of the cover body 30 between the bearings 31, the shafts 21 can be attached to/detached from the bearings 31, respectively.

As shown in FIG. 3B, each bearing 31 is provided with a protrusion 31*p* which protrudes in the axial direction on a part of an end surface 31E, which is a surface facing the other bearing 31. The protrusions 31*p* are to be press-contacted with side surfaces of the bearing supporting parts 24 (i.e., the surfaces facing the end surfaces 31E of the bearings 31). When the opening/closing cover 3 is in the closed state, the protrusions 31*p* is circumvented from contacting the side surfaces of the bearing supporting parts 24, and pressure to the side surfaces are released.

It is noted that the two bearings 31 provided to the opening/closing cover 3 and the shafts 21 provided to the bearing supporting parts 24 are formed to have clearances both in the axial direction and in a radial direction so that there exists rattling between the bearings 31 and the shafts 21 when the opening/closing cover 3 is in the closed state.

Figure 4:
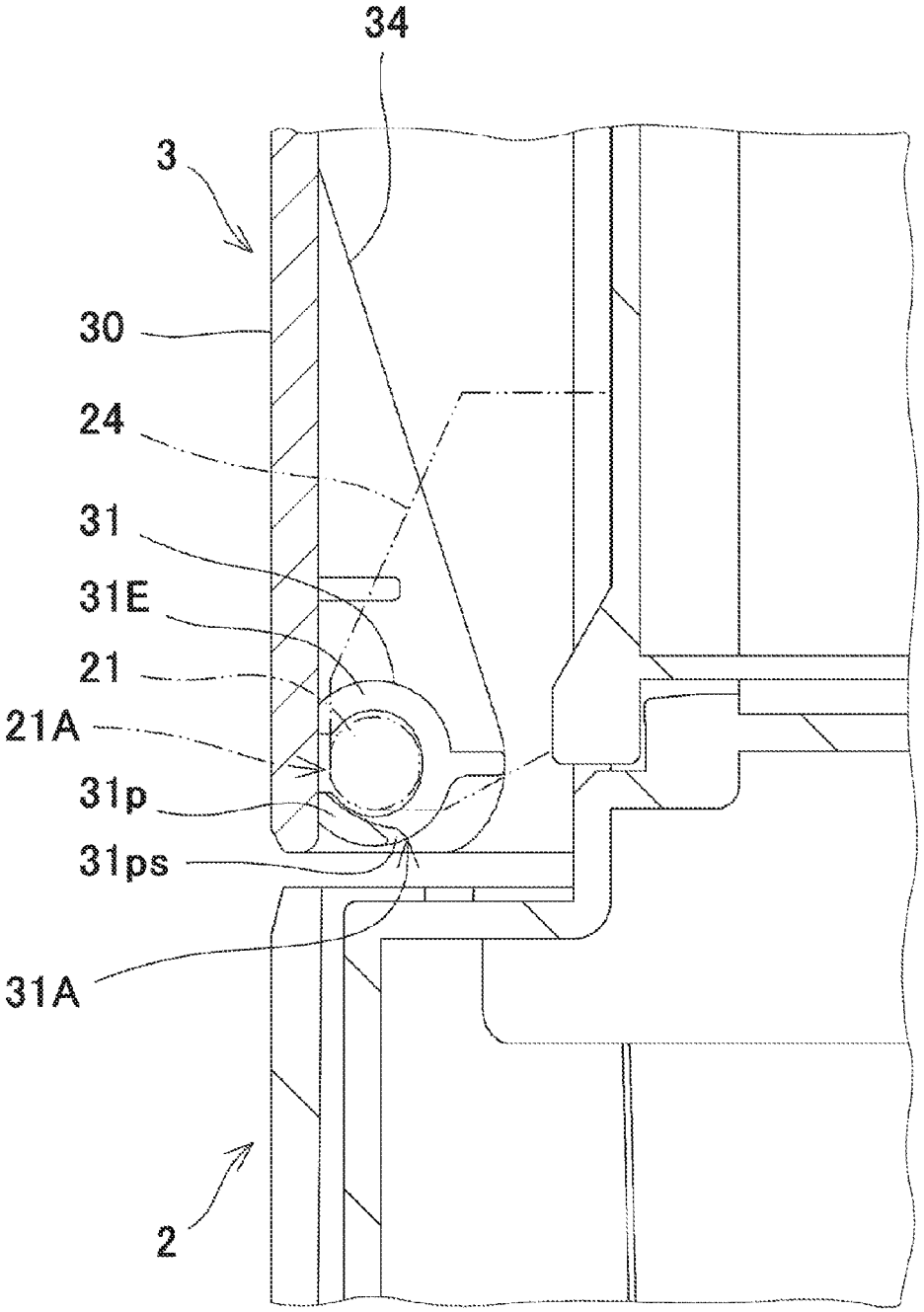
FIG. 4 is an enlarged view around a hinge part when the opening/closing cover is closed.
Figure 5:
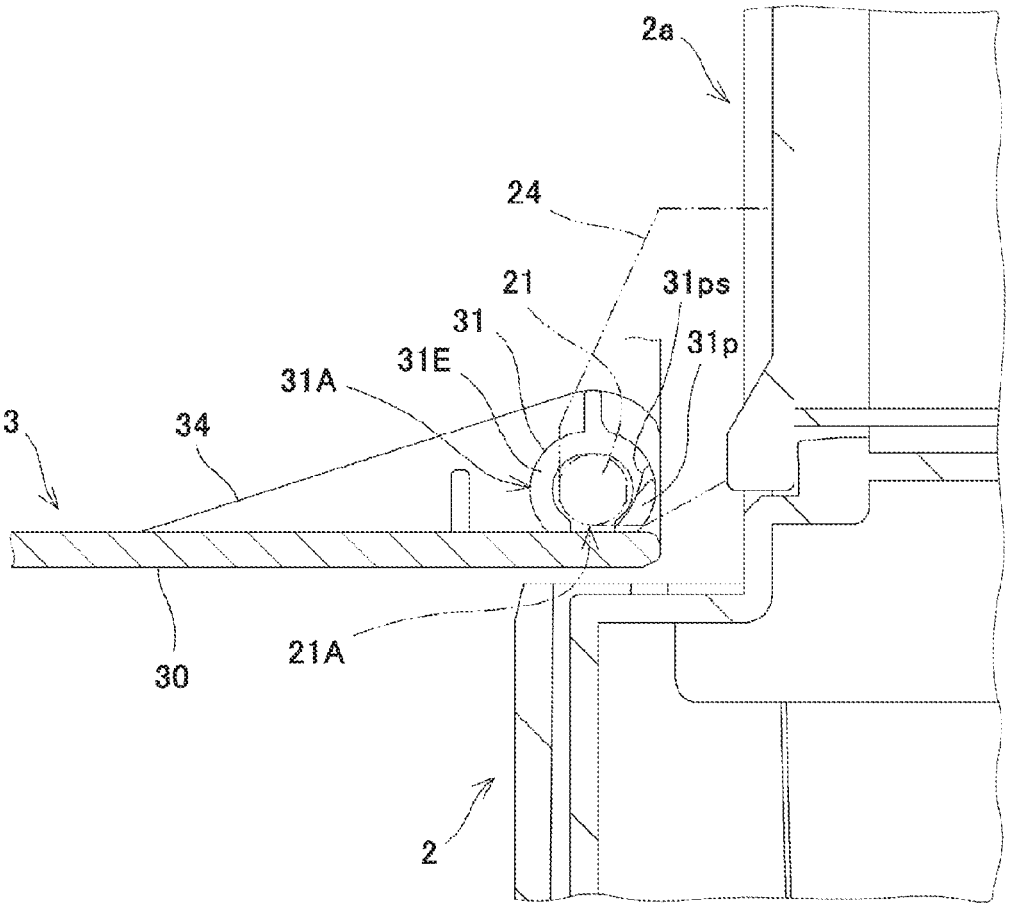
FIG. 5 is an enlarged view around the hinge part when the opening/closing cover is opened.

FIG. 4 is an enlarged view around a hinge part when the opening/closing cover 3 is in the closed state, and FIG. 5 is an enlarged view around the hinge part when the opening/closing cover 3 is in the opened state.

The shaft parts 21A having the shafts 21 as main parts are provided on the casing 2, while the bearing parts 31A having bearings 31 as main parts are provided to the opening/closing cover 3.

When the user pulls the handle 3*a* of the opening/closing cover 3 which is in the closed state as shown in FIG. 4 to release the engagement between the engaging part 22 and the engaged part 32, the opening/closing cover 3 is rotated downward by its own weight and the opening/closing cover 3 becomes in the opened state as shown in FIG. 5. When the opening/closing cover 3 is moved from a position shown in FIG. 4, a stopper part 36 shown in FIG. 3A contacts down side surfaces of the bearing supporting parts 24, thereby stopping the opening/closing cover 3 at a position shown in FIG. 5.

When the opening/closing cover 3 is opened, the protrusions 31*p* rotate together with the shafts 31 which are provided to the opening/closing cover 3 and contact the side surfaces of the shaft supporting parts 24, respectively. It is noted that the protrusions 31*p* are formed such that they start contacting the side surfaces of the shaft supporting parts 24 when the opening/closing cover 3 opens by a particular angle or more. Further, inclined surfaces 31*ps* of the protrusions 31*p* are formed such that protruding amounts thereof increase more as the opened state of the opening/closing cover 3 is closer to the opened state.

Accordingly, as the opening/closing cover 3 opens by the particular angle and further moves to be closer to the opened state, resistance against the rotation of the opening/closing cover 3 increases. With this configuration, after the opening/closing cover 3 has opened by the particular angle, the rotation speed of the opening/closing cover 3 gradually decreases. As a result, the opening/closing cover can be opened quietly.

It is noted that, in order to increase the resistance against the rotation of the opening/closing cover 3 as the opening/closing cover 3 has opened by the particular angle and further moved to be closer to the opened state, the protruding amount of the protrusion 31*p* may be gradually increased as in the above-described embodiment, or frictional resistance of the protrusion 31*p* with respect to the side surface of the shaft supporting part 24 may be gradually increased.

As described above, the portion of the cover body 30 between the two bearings 31 is formed to be bent easily. Accordingly, even if the protrusions 31*p* of the two bearings 31 contact the side surfaces of the shaft supporting parts 24, rotation of the opening/closing cover 3 is not interfered strongly, and the opening/closing cover 3 can easily be opened.

FIG. 6A schematically shows a positional relationship between the shaft part 21A and the bearing part 31A, and FIG. 6B schematically shows a positional relationship between the shaft part 21A and the bearing part 31A viewed from a direction indicated by arrow A in FIG. 6A. In FIGS. 6A and 6B, the cover body 30, the bearings 31 and the like are omitted for brevity.

FIGS. 6A and 6B shows a case where the opening/closing cover 3 is closed, and the protrusions 31*p* do not contact the side surfaces of the shaft supporting parts 24 (i.e., facing surfaces 24*e* which face the end surfaces 31E of the bearings 31, respectively). From this state, when the opening/closing cover 3 is opened, the bearings 31 provided to the opening/closing cover 3 rotate in a direction indicated by arrow 10 in FIG. 6B. As shown in FIG. 6B, when the opening/closing cover 3 is closed, the protrusions 31*p* are located at a position indicated by a solid line. When the opening/closing cover 3 has been opened, the protrusions 31*p* move to a position indicated by two-dotted lines and contact the side surfaces (i.e., the facing surfaces 24*e*) of the shaft supporting parts 24.

Since the two protrusions 31*p* formed on the side surfaces 31E of the two bearings 31 contact the side surfaces (i.e., facing surfaces 24*e*) of the two shaft supporting parts 24, respectively, the opening/closing cover 3 can be opened gently. As described above, when the opening/closing cover 3 has been opened by the particular angle, the protrusions 31*p* start contacting the side surfaces of the shaft supporting parts 24, while the protrusions 31*p* do not contact the side surfaces of the shaft supporting parts 24 before the opening/closing cover 3 has been opened by the particular angle.

The above-described embodiment shows an example in which the protrusion 31*p* is formed on a part of the side surface 31E of each bearing 31, and a relief part 24*s* is formed on a part of the facing surface 24*e* facing the end surface 31E of each bearing 31. Thus, according to the embodiment, the facing surfaces 24*e* that face the end surfaces 31E of the bearings 31 and contact the protrusions 31*p* are configured as parts of the side surfaces of the shaft supporting parts 24, respectively. Further, the relief parts 24*s*, which circumvent contact with the protrusions 31*p*, are configured by areas where the shaft supporting parts 24 do not exist.

According to the embodiment, the shaft part 21A has a shaft 21, which is a main part thereof, and the facing surface 24*e* (a part of the side surface of the shaft supporting part 24) which faces the end surface 31E of the bearing 31, and the relief part 24*s*. The bearing part 31A has a cylindrical bearing 31, which is the main part thereof, and the protrusion 31*p* formed on the end surface 31E of the bearing 31.

According to the embodiment described above, when the opening/closing cover 3 is in the closed state and closes the opening 2*a*, the protrusions 31*p* are located at a position corresponding to the relief parts 24*s*, and circumvent contact with the facing surfaces 24*e* of the shaft parts 21A. Therefore, there is rattling between the shafts 21 and the bearings 31. Because of this configuration, when the opening/closing cover is closed such that the engaged part 32 is engaged with the engaging part 22, the positioning pins 33 can easily be inserted in the positioning holes 23, respectively. Thus, positioning of the opening/closing cover 3 is not prevented. Further, when the opening/closing cover 3 in the closed state is opened by the particular angle, the protrusions 31*p* are moved out of the relief parts 24*s* and contact the facing surfaces 24*e* of the shaft parts 21A. Then, since the resistance against rotation of the opening/closing cover 3 is applied, rattling of the opening/closing cover 3 is suppressed, which enables gentle opening of the opening/closing cover 3. It is noted that the protrusions 31*p* and the relief parts 24*s* are formed on the end surfaces 31E of the bearings 31 and the facing surfaces 24*e* facing the end surfaces 31E, respectively, upsizing of the apparatus can be suppressed.

Further, according to the above-described illustrative embodiment, since the two hinges configured by the shafts 21 and the bearings 31 are arranged spaced from each other in the axial direction, and the protrusion 31*p* and the relief part 24*s* are formed to each hinge, opening/closing of the opening/closing cover 3 can be performed in a balanced manner by the two hinges.

Further, according to the illustrative embodiment, the opening/closing cover 3 is configured such that two bearings 31 are arranged between both ends, in the axial direction, of the cover body 30 and spaced from each other. Between the two bearings 31 and the both ends, in the axial direction, of the cover body 30, the reinforcement ribs 35 extending in the axial direction are provide, while a portion of the cover body 30 between the two bearings 31 have a substantially planar shape. With this configuration, the portion of the opening/closing cover 3 between the two bearings 31 is easy to be bent. Therefore, when the opening/closing cover 3 is opened, although the protrusions 31*p* contact the end surfaces 31E of the bearings 31, rotation of the opening/closing cover 3 is not strongly prevented but can be opened smoothly.

Further, according to the illustrative embodiment described above, the protrusions 31*p* are formed on the end surfaces 31E of the two bearings 31, respectively. Such a configuration may be modified such that one protrusion 31*p* are formed on only of the end surfaces 31E of the bearings 31.

Hereinafter, modified embodiments regarding the shaft part and the bearing part will be described.

<First Modified Embodiment>

FIG. 7A schematically shows a positional relationship between the shaft part 21B and the bearing part 31B viewed from a front side according to a first modified embodiment of the disclosures. FIG. 7B schematically shows a positional relationship between the shaft part 21B and the bearing part 31B viewed from aside (i.e., viewed along arrow B in FIG. 7A).

According to the first modified embodiment, the bearing parts 31B are configured such that the relief parts 31*s* having concave parts are formed on parts of the end surfaces 31E of the bearing 31*s*, respectively. Further, the shaft parts 21B is configured such that the protrusions 24*p* are formed on the facing surfaces 24*e* facing the end surfaces 31E of the bearings 31, respectively. With the structure, the same effect as in the illustrative embodiment can be obtained.

FIGS. 7A and 7B show a case where the opening/closing cover 3 is in the closed state. In this state, the protrusions 24*p* are located at positions corresponding to the relief parts 31*s* and do not contact the end surfaces 31E, respectively. When the opening/closing cover 3 is opened from the closed state shown in FIG. 7A, the bearings 31 provided to the opening/closing cover 3 rotate in a direction indicated by arrow 10 in FIG. 7B. When the opening/closing cover 3 has been opened by the particular angle, the protrusions 24*p* are moved out of the relief parts 31*s* and start contacting the end surfaces 31E of the bearings 31. Thereafter, the contacting state between the protrusions 24*p* and the end surfaces 31E remains, while the cover 3 is fully opened.

According to the first modified embodiment, each shaft part 21B has shaft 21 which is a main part, the facing surface 24*e*, which is a part of the side surface of the shaft supporting part 24 and faces the end surface 31E of the corresponding bearing 31, and the protrusion 24*p* is formed on a part of the facing surface 24*e*. Further, the bearing part 31B has, for example, the cylindrical bearing 31, as the main part and the relief part 31*s* formed on the end surface 31E of the bearing 31.

<Second Modified Embodiment>

FIG. 8A schematically shows a positional relationship between the shaft part 21C and the bearing part 31C viewed from a front side according to a second modified embodiment of the disclosures. FIG. 8B schematically shows a positional relationship between the shaft part 21C and the bearing part 31C viewed from aside (along arrow C in FIG. 8A). It is noted that in FIGS. 8A and 8B, the cover body 30 is not shown, and the bearing 31 is shown in a simplified manner.

In the second modified embodiment, each shaft part 21C is configured such that a concave relief part 21*s* is formed on a part of the end surface of the shaft 21, and the bearing part 31C is configured such that a protrusion 31*ep* is formed on the facing surface 31*e* which faces the end surface 21E of the shaft 21. With this configuration, the same effect as in the previously described embodiments can be obtained. In this case, since the protrusion 31*ep* and the relief part 21*s* are formed on the facing surface 31*e* facing the end surface 21E of the shaft 21 and the end surface 21E of the shaft, respectively. Accordingly, upsizing of the apparatus can be suppressed.

FIGS. 8A and 8B show a case where the opening/closing cover 3 is in the closed state. In this state, the protrusions 31*ep* are located at positions corresponding to the relief parts 21*s* and do not contact the end surfaces 21E of the shafts 21, respectively. When the opening/closing cover 3 is opened from the closed state shown in FIG. 8A, the bearings 31 provided to the opening/closing cover 3 rotate in a direction indicated by arrow 10 in FIG. 8B. When the opening/closing cover 3 has opened by the particular angle, the protrusions 31*ep* are moved out of the relief parts 21*s* and start contacting the end surfaces 21E of the shafts 21, respectively. Thereafter, the contacting state between the protrusions 31*ep* and the end surfaces 21E of the shaft 21 remains, while the cover 3 is fully opened.

According to the second modified embodiment, each shaft part 21C has a shaft 21 which is a main part, and the relief part 21*s* formed on a part of the end surface 21E of the shaft 21. Further, each bearing part 31C has the cylindrical bearing 31 which is the main part of the bearing part 31C, the opposite part 31*e* facing the end surface 21E of the shaft 21, and the protrusion 31*ep* formed on the facing surface 31*e*. it is noted that he facing surface 31*e* is configured, for example by a part of the side surface of the bearing supporting part 34.

<Third Modified Embodiment>

According to the third embodiment, the members on which the protrusions and relief parts are formed in the second modified embodiment are interchanged. That is, the protrusions are formed on parts of the end surfaces 21E of the shafts, while the concave relief parts are formed on the facing surfaces 31*e* facing the end surfaces 21E of the shafts 21. With the structure, the same effect as in the second modified embodiment can be obtained.

According to the third modified embodiment, each shaft part has the shaft 21 which is a main part, and the protrusion formed on a part of the end surface 21E of the shaft 21. Further, each bearing part has the cylindrical bearing 31 which is the main part of the bearing part, the opposite part 31*e* facing the end surface 21E of the shaft 21, and the relief part formed on the facing surface 31*e*.

It is noted that, in each of the first through third modified embodiments, the configuration may be modified such that only one of the two hinges is provided with the protrusions, the facing surface and the relief part.

The relief part may be configured such that no member exists as the relief part 24*s* (see FIG. 6B). Alternatively, as in the first through third modified embodiments, the relief part may be configured as convex parts. When the protrusion is formed on the end surface 31E of the bearing 31, or on the end surface 21E of the shaft 21, the relief part formed on the facing surface which faces the end surface on which the protrusion is formed may be configured by the area at which no member exists or by the through holes (grooves) formed thereon.

In any of the configurations described above, the bearing 31 needs not be limited to that having the cylindrical shape, but may have any shape as far as the shaft 21 is rotatably supported, and may have a C-shaped cross section taken along a plane orthogonal to the axial direction.

According to the illustrative embodiment, the shaft part is provided to the casing 2, and the bearing part is provided at the down side part of the cover body 30 when the opening/closing cover 3 is in the closed state. This configuration may be modified such the shaft part may be provided at the down side part of the cover body 30 when the opening/closing cover 3 is in the closed state, and the bearing part may be provided to the casing 2.

According to the illustrative embodiment, the opening/closing structure of the opening/closing cover 3 is applied to the opening/closing cover 3. It is noted that the opening/closing structure described above may also be applied to the opening/closing cover 4.

Based on the above description, it is apparent that various improvements and/or modifications may be made by a person having an ordinary skill in this field. Therefore, the above description should be interpreted merely illustrative examples, which are provided to suggest the best configuration to realize the aspects of the disclosures. It is noted that the configurations and/or functions may be modified in various ways without departing the gist of the disclosures.

It is noted that various connections are set forth between elements in the following description. It is noted that these connections in general and, unless specified otherwise, may be direct or indirect and that this specification is not intended to be limiting in this respect.

What is claimed is:

1. An opening/closing structure of a cover, comprising:

a casing having an opening; and a cover configured to be rotatable with respect to the casing to open/close the opening, wherein one of the casing and the cover is formed with a shaft part having a shaft, and the other of the casing and the cover is formed with a bearing part having a bearing, wherein one of the shaft part and the bearing part is formed with a protrusion on a part of an end surface in an axial direction, and the other of the shaft part and the bearing part is formed with a contact portion on a part of a facing surface which faces the end surface, wherein the protrusion circumvents contacting the contact portion when the cover is in a closed state in which the cover closes the opening, wherein, when the cover is in an open state in which the cover is opened, from the closed state, by a particular angle, the protrusion contacts the contact portion so as to be applied with a resistant force against rotation of the cover, and wherein the protrusion protrudes in the axial direction and extends along a rotation direction of the cover.

2. The opening/closing structure according to claim 1, wherein the protrusion is formed on the end surface of the bearing part, wherein the shaft part includes a shaft supporting part having a side surface on which the shaft is provided, and wherein the contact portion is configured by a part of the side surface of the shaft supporting part.

3. The opening/closing structure according to claim 1, wherein, when the cover is rotated so that a state of the cover changes from the closed state to the open state, the closer the state of the cover becomes to the open state, the larger a resistance against a rotational force of the cover is after the cover has been opened by the particular angle.

4. The opening/closing structure according to claim 1, wherein, when the cover is rotated so that a state of the cover changes from the closed state to the open state, the closer the state of the cover becomes to the open state, the larger a protruding amount of the protrusion is after the cover has been opened by the particular angle.

5. The opening/closing structure according to claim 1, wherein the cover is configured such that two shafts or two bearings are arranged spaced from each other in the axial direction, between both ends, in the axial direction, of the cover, wherein the cover further comprises reinforcement ribs extending in the axial direction, wherein each of the reinforcement ribs is arranged between one of the two shafts and one of the ends of the cover or between one of the two bearings and one of the ends of the cover, and wherein a portion of the cover between the two shafts or the two bearings, with respect to the axial direction, is formed to be a planar part.

6. The opening/closing structure according to claim 1, wherein two hinges each being configured by the shaft and the bearing are arranged to be separated from each other in the axial direction.

7. The opening/closing structure according to claim 1, wherein the cover is provided with an engaged part configured to be engaged with an engaging part provided to the casing when the cover is in the closed state.

* * * * *